US007121662B2

(12) United States Patent
Takagi

(10) Patent No.: US 7,121,662 B2
(45) Date of Patent: Oct. 17, 2006

(54) IMAGE FORMING APPARATUS

(75) Inventor: Masaaki Takagi, Daito (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 10/893,538

(22) Filed: Jul. 19, 2004

(65) Prior Publication Data

US 2005/0036024 A1 Feb. 17, 2005

(30) Foreign Application Priority Data

Jul. 17, 2003 (JP) ..... 2003-198173

(51) Int. Cl.
*B41J 29/42* (2006.01)

(52) U.S. Cl. ..... 347/104; 347/19; 400/55; 400/703

(58) Field of Classification Search ..... 347/104, 347/19; 400/55, 56, 703; 250/239
See application file for complete search history.

(56) References Cited

U.S. PATENT DOCUMENTS 5,130,807 A * 7/1992 Tanabe et al. ..... 358/296
5,171,980 A * 12/1992 Marzullo et al. ..... 250/223 R
6,464,414 B1 * 10/2002 Washnock ..... 400/56

FOREIGN PATENT DOCUMENTS

JP 2000-037915 2/2000
JP 2005022122 A * 1/2005

* cited by examiner

*Primary Examiner*—Daniel J. Colilla
*Assistant Examiner*—Jill E. Culler
(74) *Attorney, Agent, or Firm*—Crowell & Moring LLP

(57) ABSTRACT

An image forming apparatus includes: an upper part cover for covering the upper part of the body; a paper feeding portion disposed rearward of the upper part cover, into which paper is supplied; and a medium sensor disposed opposite the paper feeding portion, which judges the quality of paper; wherein a supporting portion molded integrally with the upper part cover for rotatably supporting the medium sensor is provided, and the medium sensor is provided with the first turning center supported on the supporting portion and the second turning center for rotatably holding the tip end portion at the free end side.

5 Claims, 6 Drawing Sheets

IMAGE FORMING APPARATUS

BACKGROUND OF THE INVENTION

1. Field of the Invention

The present invention relates to an image forming apparatus for forming images on paper; and in particular, to an image forming apparatus having a medium sensor for judging the quality of paper.

2. Description of the Related Art

A prior art image forming apparatus is shown in JP-A-2000-37915. The image forming apparatus has a medium sensor for judging the quality of paper. The medium sensor emits light toward paper, receives reflection light therefrom, and judges the quality of paper such as premium grade paper, transparent paper, coated paper, photograph paper, etc., on the basis of the reflectivity of the paper, whereby the paper feeding speed and ink quantity are varied in compliance with the paper.

FIG. 5 is a side-sectional view showing a prior art image forming apparatus having a medium sensor. The image forming apparatus 1 has the lower part of its body covered by the lower part cover 2 and has the upper part thereof covered by the upper part cover 3. A paper feeding portion 4 is provided rearward of the upper part cover 3 via an opening 4*a*. The paper feeding portion 4 is formed to be integral with the lower part cover 2 and retains paper fed through the opening 4*a*.

A printing portion 9 for printing on paper, which is fed from the paper feeding portion 4 by rollers (not illustrated), is disposed forward of the paper feeding portion 4. The printing portion 9 includes an ink cartridge 6 which is held for scanning in the paper width direction by a carrier frame 7. Paper feeding is carried out by rollers 8, and an image is formed on the paper by causing the ink cartridge 6 to scan.

A medium sensor 10 is disposed between the paper feeding portion 4 and the printing portion 9 opposite the paper feeding portion 4. The medium sensor 10 includes an arm portion 12 having an axial hole 10*a* and a detection portion 13 attached to the tip end of the arm portion 12.

As shown in the upper surface view of FIG. 6, the medium sensor 10 is pivotally supported through the axial hole 10*a* on the sensor shaft 5 attached extending from the side portion of the lower part cover 2 (Refer to FIG. 5). A pressing spring 11 is provided in the circumference of the axial hole 10*a* of the medium sensor 10. The medium sensor 10 is pressed into the direction of the arrow A by the pressing spring 11, and the detection portion 13 coheres paper fed into the paper feeding portion 4. The detection portion 13 has a light-emitting element and a light receiving element (both are not illustrated), and emits light to the paper and receives reflection light by its light receiving element, whereby it becomes possible to judge the quality of paper.

However, according to the above-described prior art image forming apparatus 1, the disposing angle of the medium sensor 10 with respect to paper varies, depending on the number of sheets of paper supplied into the paper feeding portion 4. Therefore, there is a problem in that the detection portion 13 cannot sufficiently cohere the paper and the accuracy in judgement on the paper quality is lowered.

Also, the turning center (axial hole 10*a*) of the medium sensor is disposed in the vicinity of the paper feeding portion 4. Thereby, the detection portion 13 of the medium sensor 10 moves roughly in the vertical direction with respect to the paper feeding portion 4, and the width of the disposing angle of the medium sensor 10 with respect to paper is devised to become smaller. Therefore, it becomes necessary to provide a sensor shaft 5 which is disposed opposite the paper feeding portion 4 in order to cause the turning center of the medium sensor 10 to come close to the paper feeding portion 4, wherein there is another problem in that the number of components is increased.

SUMMARY OF THE INVENTION

It is an object of the present invention to provide an image forming apparatus capable of improving the judgement accuracy of a medium sensor. In addition, it is another object of the invention to provide an image forming apparatus in which the number of components can be decreased.

In order to solve the above-described objects, the invention is featured in that an image forming apparatus includes: an upper part cover for covering the upper part of the body; a paper feeding portion disposed rearward of the upper part cover, into which paper is supplied; and a medium sensor disposed opposite the paper feeding portion, which judges the quality of paper; wherein a supporting portion molded integrally with the upper part cover for rotatably supporting the medium sensor is provided, and the medium sensor is provided with a first turning center supported on the supporting portion and a second turning center for rotatably holding the tip end portion at the free end side.

According to the construction, as paper is supplied into the paper feeding portion, the medium sensor causes its tip end portion to turn on the basis of the first turning center supported by the supporting portion formed integrally with the upper part cover and the second turning center secured at the free end side, and the medium sensor is caused to cohere paper.

Therefore, a sensor shaft is unnecessary to the invention.

Also, the invention is featured in that an image forming apparatus includes: a carrier frame extending in the scanning direction of an ink cartridge for holding the ink cartridge; a paper feeding portion disposed rearward of the carrier frame, into which paper is supplied; and a medium sensor disposed opposite the paper feeding portion for judging the quality of paper; wherein a supporting portion for rotatably supporting the medium sensor is provided in the carrier frame by erecting is provided, and the medium sensor is provided with a first turning center supported on the supporting portion and a second turning center for rotatably holding the tip end portion at the free end side.

According to the above-described construction, as paper is supplied into the paper feeding portion, the medium sensor causes its tip end portion to rotate by the first turning center supported by the supporting portion formed on the carrier frame by erecting therefrom and the second turning center secured at the free end side, and the medium sensor is caused to cohere paper.

In addition, the invention is featured in that an image forming apparatus includes: a paper feeding portion into which paper is supplied and a medium sensor disposed opposite the paper feeding portion for judging the quality of paper; wherein the medium sensor is provided with a first turning center rotatably supported on the body and a second turning center for rotatably holding the tip end portion at the free end side.

According to the above-described construction, the tip end portion is caused to rotate by the first turning center supported by the supporting portion formed on the body and the second turning center secured at the free end side and is caused to cohere the paper. Also, the above-described respective supporting portions have an axial portion or an axial hole which becomes the first turning center.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
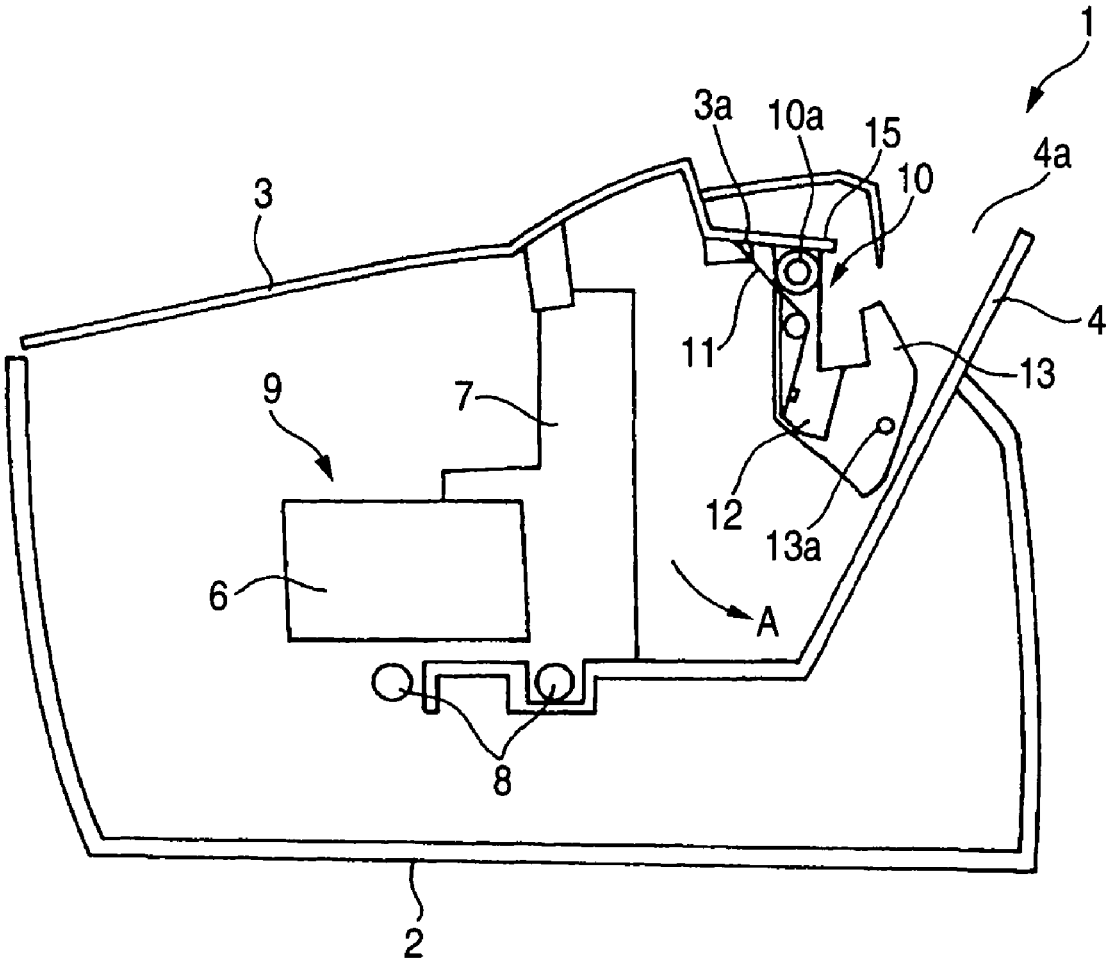
FIG. 1 is a side-sectional view showing an image forming apparatus according to the first embodiment of the invention.
Figure 5:
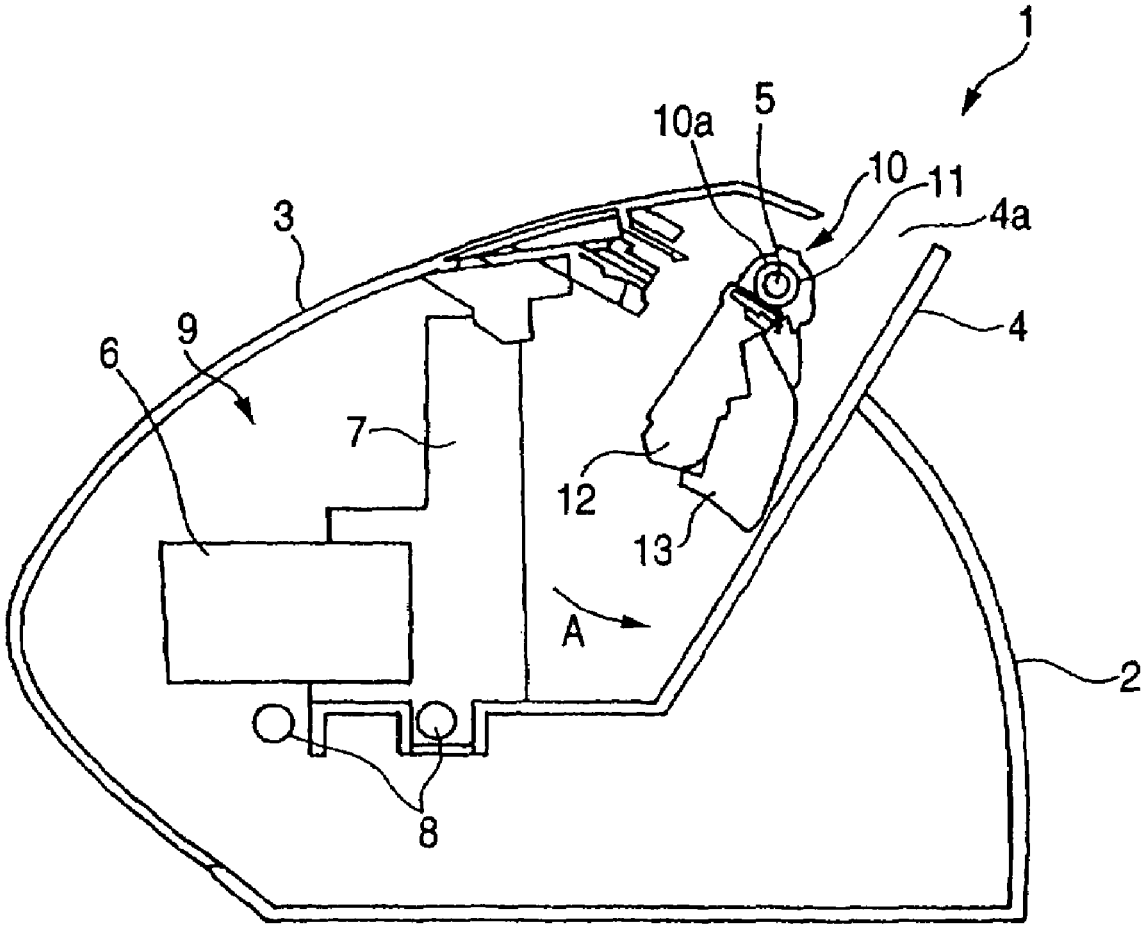
FIG. 5 PRIOR ART
FIG. 5 is a side-sectional view showing a prior art image forming apparatus.
Figure 6:
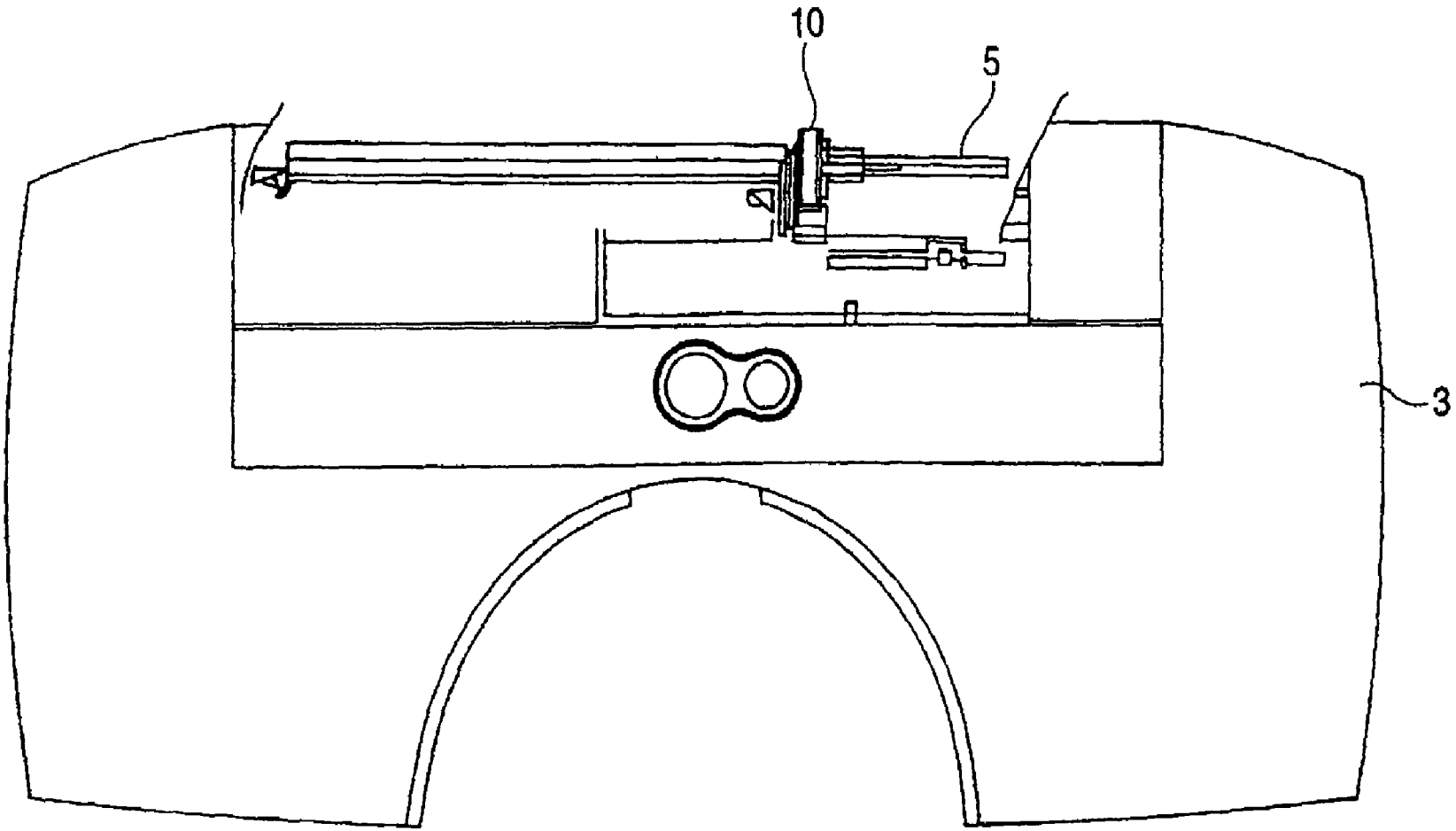
FIG. 6 PRIOR ART
FIG. 6 is an upper surface view showing the prior art image forming apparatus.

Hereinafter, a description is given of embodiments of the invention with reference to the accompanying drawings. For convenience of description, parts which are similar to those of the prior art example shown in FIG. 5 and FIG. 6 are given the same reference numbers. FIG. 1 is a side sectional view showing an image forming apparatus according to a first embodiment. The image forming apparatus 1 has its lower part body covered by the lower part cover 2 and has its upper part body covered by the upper part cover 3. The paper feeding portion 4 is provided rearward of the upper part cover 3 via the opening 4*a*. The paper feeding portion 4 is formed integrally with the lower part cover 2 and is devised to hold paper which is supplied by the opening 4*a*.

A printing portion 9 for printing on paper fed from the paper feeding portion 4 by rollers (not illustrated) is disposed forward of the paper feeding portion 4. The printing portion 9 includes a roller 8 and an ink cartridge 6 which is held so as to scan in the width direction of paper by the carrier frame 7 made of a metal plate. The printing portion 9 feeds paper by means of the rollers 8 and forms an image on the paper by causing the ink cartridge 6 to scan.

Figure 2:
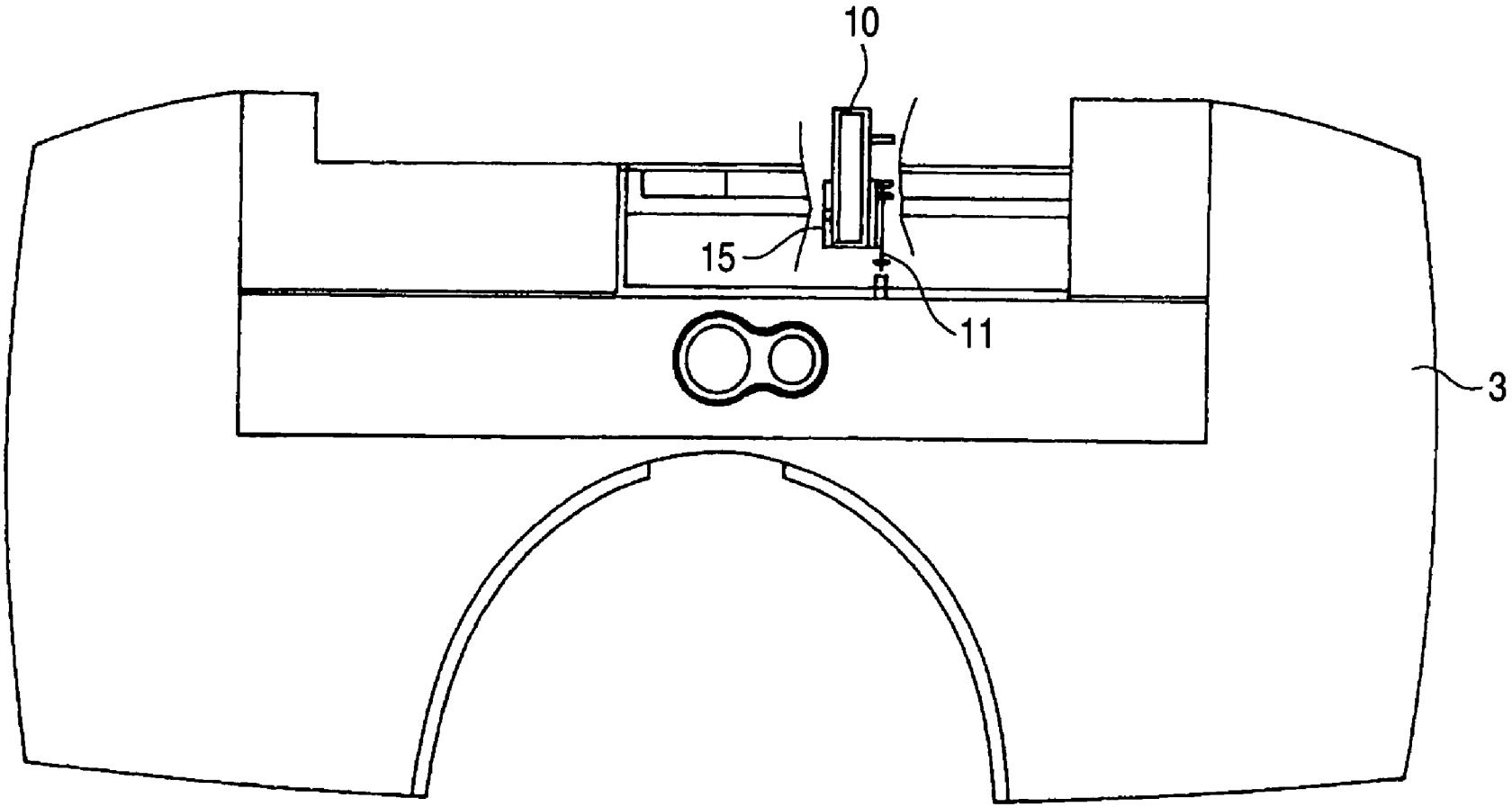
FIG. 2 is an upper surface view showing the upper part cover and medium sensor of the image forming apparatus according to the first embodiment of the invention.

The medium sensor 10 is disposed between the paper feeding portion 4 and the printing portion 9 opposite the paper feeding portion 4. The medium sensor 10 includes an arm portion 12 having the axial hole 10*a* and a detection portion 13 (tip end portion) which is disposed at the tip end at the free end side of the medium sensor 10 and rotatably supported in the axial hole 13*a* with respect to the arm portion 12. A supporting portion 15 is formed at the rear portion of the upper part cover 3 integrally therewith. The supporting portion 15 has an axial portion, and the medium sensor 10 is pivotally supported with the axial portion fitted into the axial hole 10*a*. Thereby, as shown in FIG. 2, the medium sensor 10 is disposed at a prescribed position.

A pressing spring 11 is attached to the arm portion 12. The pressing spring 11 is engaged with the protruding portion 3*a* secured on the upper part cover 3 and presses the medium sensor 10 in the direction of the arrow A, whereby the arm portion 12 turns in the axial hole 10*a* (the first turning center) with respect to the upper part cover 3, and at the same time, the detection portion 13 turns in the axial hole 13*a* (the second turning center) with respect to the arm portion 12. As a result, the detection portion 13 coheres the paper supplied into the paper feeding portion 4.

The detection portion 13 has a light-emitting element and a light-receiving element (both are not illustrated), and emits light to paper and receives reflection light by its light-receiving element, whereby it becomes possible to judge the paper quality.

As paper is supplied into the paper feeding portion 4 in the image forming apparatus 1 constructed as described above, the detection portion 13 of the medium sensor 10 coheres paper and the paper quality is judged. When an instruction for forming an image is issued, paper is supplied to the printing portion 9 by drive of the rollers (not illustrated) provided in the vicinity of the paper feeding portion 4.

The ink cartridge 6 is caused to scan in the width direction of paper while the printing portion 9 feeds paper by means of the rollers 8. Therefore, an image is formed on the paper, and when the image formation is finished, the paper is ejected by the rollers 8.

According to the present embodiment, since the medium sensor 10 is constructed so as to be rotatable on the basis of the first and second turning centers (10*a* and 13*a*), it is possible to cause the detection portion 13 to cohere paper regardless of the number of sheets of paper. Therefore, the judgement accuracy of paper quality can be improved.

Further, since the medium sensor 10 has the first and second turning centers, it is possible to cause the detection portion 13 to cohere paper even if the first turning center (10*a*) supported by the body is disposed at a position apart from the paper feeding portion 4. Therefore, it is possible to easily mold the supporting portion 15, which pivotally supports the medium sensor 10, integrally with the upper part cover 13 by a molding process. Accordingly, the prior art center shaft 5 (Refer to FIG. 6) can be removed. In addition, the axial hole may be formed at the supporting portion 15, and the axial portion may be formed at the medium sensor 10.

Figure 3:
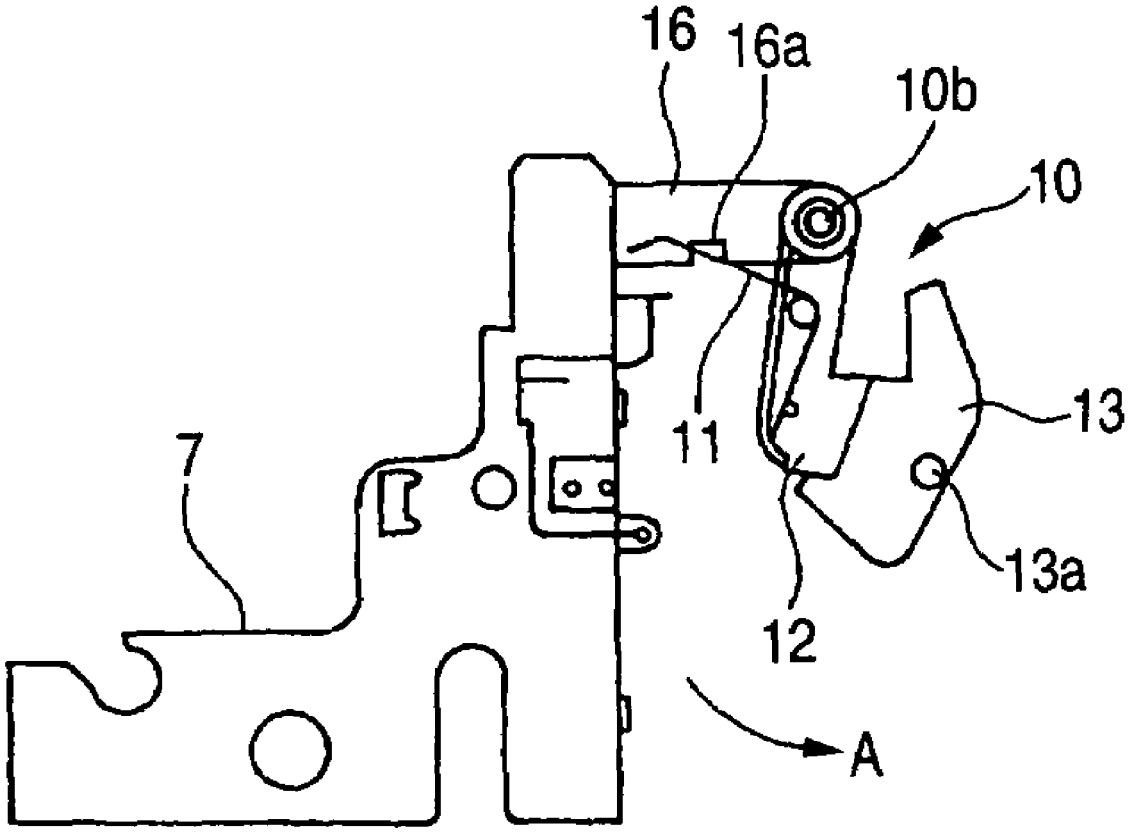
FIG. 3 is a side-sectional view showing an image forming apparatus according to the second embodiment of the invention.
Figure 4:
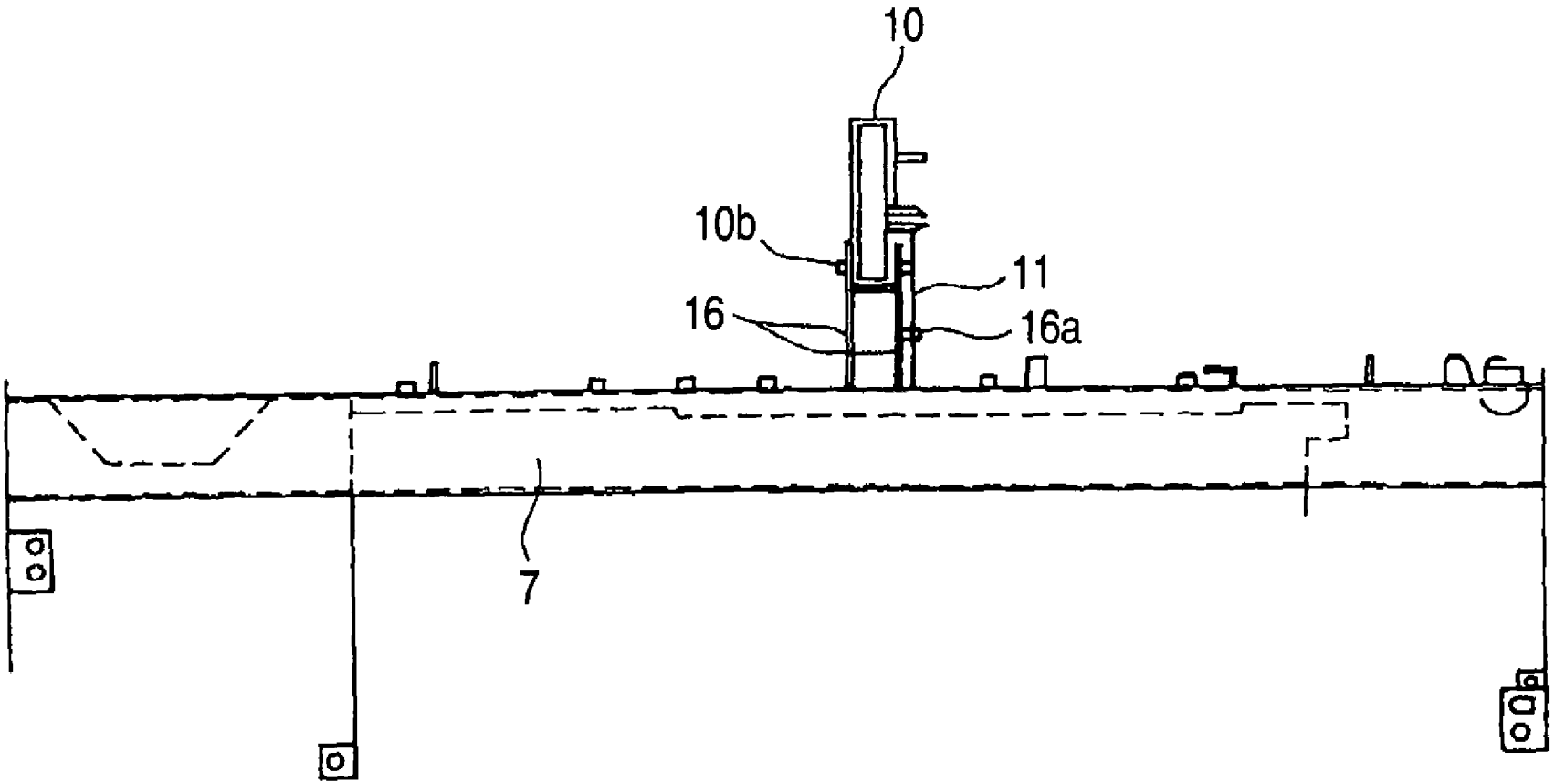
FIG. 4 is an upper surface view showing the carrier frame and medium sensor of the image forming apparatus according to the second embodiment of the invention.

Next, a description is given of a second embodiment. In the present embodiment, a supporting portion for pivotally supporting the medium sensor 10 is provided on the carrier frame 7. The parts other than this portion are similar to those of the first embodiment. FIG. 3 and FIG. 4 are a side-sectional view and an upper surface view, respectively, showing the carrier frame 7 to which the medium sensor 10 is attached.

The supporting portion 16 is formed on the carrier frame 7 made of a metal plate by erecting it therefrom. An axial hole is formed in the supporting portion 16, and an axial portion 10*b* provided at the medium sensor 10 is fitted into the corresponding hole, whereby the medium sensor 10 is pivotally supported centering around the axial portion 10*b*.

Further, the pressing spring 11 is engaged with the protruding portion 16*a* secured at the supporting portion 16 and presses the medium sensor 10 in the direction of the arrow A, whereby the arm portion 12 turns at the axial portion 10*b* (the first turning center) with respect to the carrier frame 7, and simultaneously the detection portion 13 turns in the axial hole 13*a* (the second turning center) with respect to the arm portion 12. As a result, the detection portion 13 coheres paper supplied into the paper feeding portion 4 (Refer to FIG. 1).

Therefore, as in the first embodiment, the detection portion 13 is caused to cohere paper regardless of the number of sheets of paper. As a result, it is possible to improve the judgement accuracy of the paper quality. In addition, it is possible to easily form the supporting portion 16, which pivotally supports the medium sensor 10, integrally with the carrier frame 7 by erecting therefrom. Therefore, a prior art sensor shaft 5 can be removed (Refer to FIG. 6). Also, the axial portion may be formed at the supporting portion 16, and the axial hole may be formed on the medium sensor 10.

According to the present invention, since the medium sensor is constructed so as to be rotatable on the basis of the first and second turning centers, it is possible to cause the medium sensor to cohere paper regardless of the number of sheets of paper. Therefore, the judgement accuracy of the paper quality can be improved.

Also, since the medium sensor has the first and second turning centers, it is possible to cause the detection portion to cohere paper even if the first turning center supported on the body is disposed at a position apart from the paper feeding portion. Therefore, it is possible to easily form the supporting portion, which pivotally supports the medium sensor, integrally with the upper part cover and carrier frame. Therefore, the prior art sensor shaft can be removed.

What is claimed is:

1. An image forming apparatus comprising:

an upper part cover for covering the upper part of a body;

a paper feeding portion disposed rearward of the upper part cover, into which paper is supplied;

a medium sensor disposed opposite the paper feeding portion, which judges the quality of the paper supplied into the paper feeding portion;

a supporting portion of the upper part cover for rotatably supporting the medium sensor;

a first turning center supported on the supporting portion; and a second turning center for rotatably holding a tip end portion of the medium sensor at a free end side of the medium sensor.

2. The image forming apparatus of claim 1, wherein the tip end portion of the medium sensor coheres with the paper supplied into the paper feeding portion.

3. An image forming apparatus comprising:

a carrier frame extending in the scanning direction of an ink cartridge for holding the ink cartridge;

a paper feeding portion disposed rearward of the carrier frame, into which paper is supplied;

a medium sensor disposed opposite the paper feeding portion for judging the quality of the paper supplied into the paper feeding portion;

a supporting portion, which is provided in the carrier frame by erecting, for rotatably supporting the medium sensor;

a first turning center supported on the supporting portion; and a second turning center for rotatably holding a tip end portion of the medium sensor at a free end side of the medium sensor.

4. The image forming apparatus of claim 3, wherein the tip end portion of the medium sensor coheres with the paper supplied into the paper feeding portion.

5. An image forming apparatus comprising:

a paper feeding portion into which paper is supplied; and a medium sensor disposed opposite the paper feeding portion for judging the quality of the paper supplied into the paper feeding portion;

a first turning center rotatably supported on the body of the medium sensor; and a second turning center for rotatably holding a tip end portion of the medium sensor at a free end side of the medium sensor;

wherein the tip end portion of the medium sensor coheres with the paper supplied into the paper feeding portion.

* * * * *